US010627081B1

(12) United States Patent
Owens et al.

(10) Patent No.: US 10,627,081 B1
(45) Date of Patent: Apr. 21, 2020

(54) LED LIGHTING MODULE INCLUDING A RIGID CARRIER COMPONENT

(71) Applicant: Eaton Intelligent Power Limited, Dublin (IE)

(72) Inventors: Walten Peter Owens, Chittenango, NY (US); Khurram Moghal, Senoia, GA (US); Benjamin David Vollmer, Manlius, NY (US); Priya Ranjan Haridasan, Syracuse, NY (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/351,960

(22) Filed: Mar. 13, 2019

(51) Int. Cl.

| | |
|---|---|
| ***F21V 17/06*** | (2006.01) |
| ***F21V 31/00*** | (2006.01) |
| ***F21V 7/24*** | (2018.01) |
| ***F21V 5/00*** | (2018.01) |
| *F21Y 115/10* | (2016.01) |

(52) U.S. Cl.
CPC ..... *F21V 17/06* (2013.01); *F21V 5/007* (2013.01); *F21V 7/24* (2018.02); *F21V 31/005* (2013.01); *F21Y 2115/10* (2016.08)

(58) Field of Classification Search
CPC ..... F21V 31/005; F21V 5/007; F21V 5/04; F21V 17/06; F21V 29/70
See application file for complete search history.

(56) References Cited

U.S. PATENT DOCUMENTS

| | | | |
|---|---|---|---|
| 9,759,418 | B2 | 9/2017 | Nolan et al. |
| 2017/0184272 | A1 | 6/2017 | Nolan et al. |

*Primary Examiner* — Joseph L Williams
(74) *Attorney, Agent, or Firm* — Fox Rothschild LLP

(57) ABSTRACT

A lighting module is disclosed. The lighting module includes a substrate for holding a plurality of light emitting diodes (LEDs), optical component, and a rigid carrier configured to interface with the substrate and seal the optical component to the substrate. The optical component includes a plurality of optical elements, each positioned to be located over one of the plurality of LEDs and a peripheral portion. The peripheral portion is configured to wrap around a side wall of the rigid carrier.

20 Claims, 6 Drawing Sheets

LED LIGHTING MODULE INCLUDING A RIGID CARRIER COMPONENT

BACKGROUND

The advent of light emitting diode (LED) based luminaires has provided sports arenas, stadiums, other entertainment facilities, and other commercial and industrial facilities the ability to achieve instant on-off capabilities, intelligent controls and adjustability while delivering excellent light quality, consistent light output, and improved energy efficiency. Because of this, users continue to seek improvements in LED lighting devices. For example, new and improved ways to protect the luminaire from outdoor elements such as moisture and dirt are desired. If the luminaire unit is not waterproof, moisture will penetrate to reach the internal circuitry of the LED devices, and the luminaire unit will stop working. Creating a sealed fixture is particularly important when the fixture will be exposed to harsh environments, such as weather when the fixture is used for outdoor or street lighting.

Generally, a light emitting device includes a housing with a light emitting diode (LED) substrate mounted thereon and a lens for covering the LED substrate for improving a light emission efficiency within a certain range of viewing angles. The LED substrate may include a plurality of LED light sources (e.g., LED chips). Such light emitting devices are manufactured by attaching one or more lenses on top of the LED chips included in the LED substrate. The lens(es) may be secured using a carrier around the LED substrate, and a gasket is used for creating a seal between the LED substrate and the carrier. Traditionally, for an LED array, each lens component that covers the individual LEDs of the LED array must be manufactured separately and then fitted into the carrier using, for example, injection molding, and must be preassembled before securing to the fixture. This may lead to weak bonding between the components of the light emitting device, and added manufacturing cost and complexity.

This document describes a lighting fixture and methods of manufacturing thereof that are directed to solving the issues described above, and/or other problems.

SUMMARY

In one or more embodiments, a lighting module may include a substrate configured for holding a plurality of light emitting diodes (LEDs), an optical component, and a rigid carrier configured to interface with the substrate and seal the optical component to the substrate. The optical component may include a plurality of optical elements (each positioned to be located over one of the plurality of LEDs) and a peripheral portion. The peripheral portion may be configured to wrap around a side wall of the rigid carrier.

Each of the plurality of optical elements may include a parabolic shaped optical structure such that an LED may be positioned at a focus of the parabolic shaped optical structure. Optionally, each of the plurality of optical elements may also include a cylindrical channel that extends longitudinally through that optical element and is configured to be positioned over an LED.

In certain embodiments, the optical structure may be formed from a flexible material such as, for example and without limitation, optical silicone.

In one or more embodiments, the optical component may be a one piece structure such that the plurality of optical elements form an integral part of the optical structure.

In at least one embodiment, the rigid carrier may be configured to provide reflective properties for light emitted by the plurality of LEDs. Optionally, the rigid carrier may be formed from an opaque polycarbonate material.

In one or more embodiments, the lighting module may also include a gasket configured to provide a water tight seal between the optical component and the substrate. The gasket may be formed from material such as, without limitation, silicone, thermoplastic elastomers, rubber, or foam.

In one or more embodiments, the lighting module may also include one or more securing means for secure attachment of the optical component to the rigid carrier.

In certain embodiments, the rigid carrier may include a plurality of support structures that each may be configured to receive and support an optical element of the optical component. Optionally, the rigid carrier further may also include a plurality of lateral connecting structures disposed between the plurality of support structures.

In at least one embodiment, an inside of the side wall of the rigid carrier may include a ridge for receiving the peripheral portion of the optical component.

Optionally, the peripheral portion of the optical component may be configured to assume a shape that is similar to that of the side wall of the rigid carrier.

In one or more aspects, a lighting device may include a housing and a plurality of lighting modules. Each lighting module may include a substrate configured for holding a plurality of light emitting diodes (LEDs), an optical component, and a rigid carrier configured to interface with the substrate and seal the optical component to the substrate. The optical component may include a plurality of optical elements (each positioned to be located over one of the plurality of LEDs) and a peripheral portion. The peripheral portion may be configured to wrap around a side wall of the rigid carrier.

DETAILED DESCRIPTION

As used in this document, the singular forms "a," "an," and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to."

When used in this document, terms such as "top" and "bottom," "upper" and "lower", or "front" and "rear," are not intended to have absolute orientations but are instead intended to describe relative positions of various components with respect to each other. For example, a first component may be an "upper" component and a second component may be a "lower" component when a light fixture is oriented in a first direction. The relative orientations of the components may be reversed, or the components may be on the same plane, if the orientation of a light fixture that contains the components is changed. The claims are intended to include all orientations of a device containing such components.

In this document, the term "lighting module" is used to refer to a device that includes a source of optical radiation. Sources of optical radiation may include, for example, light emitting diodes (LEDs), light bulbs, ultraviolet light or infrared sources, or other sources of optical radiation. In the embodiments disclosed in this document, the optical radiation emitted by the lighting modules includes visible light. One or more lighting modules may be included in a lighting device or fixture that will also include a housing, one or more electrical components for conveying power from a power supply to the optical radiation source, and optionally control circuitry.

Figure 1A:
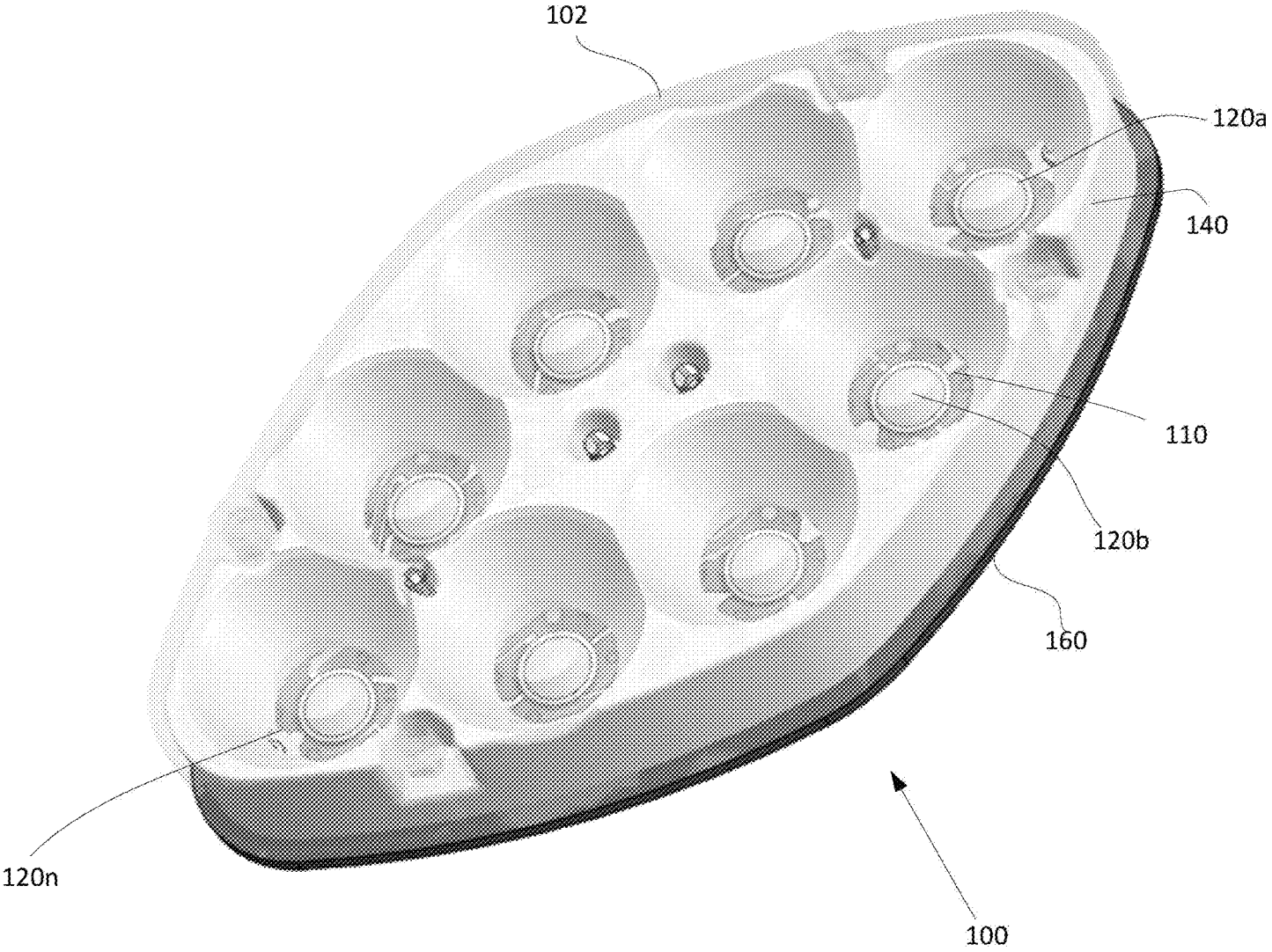
FIG. 1A illustrates a perspective view of a lighting module.
Figure 1B:
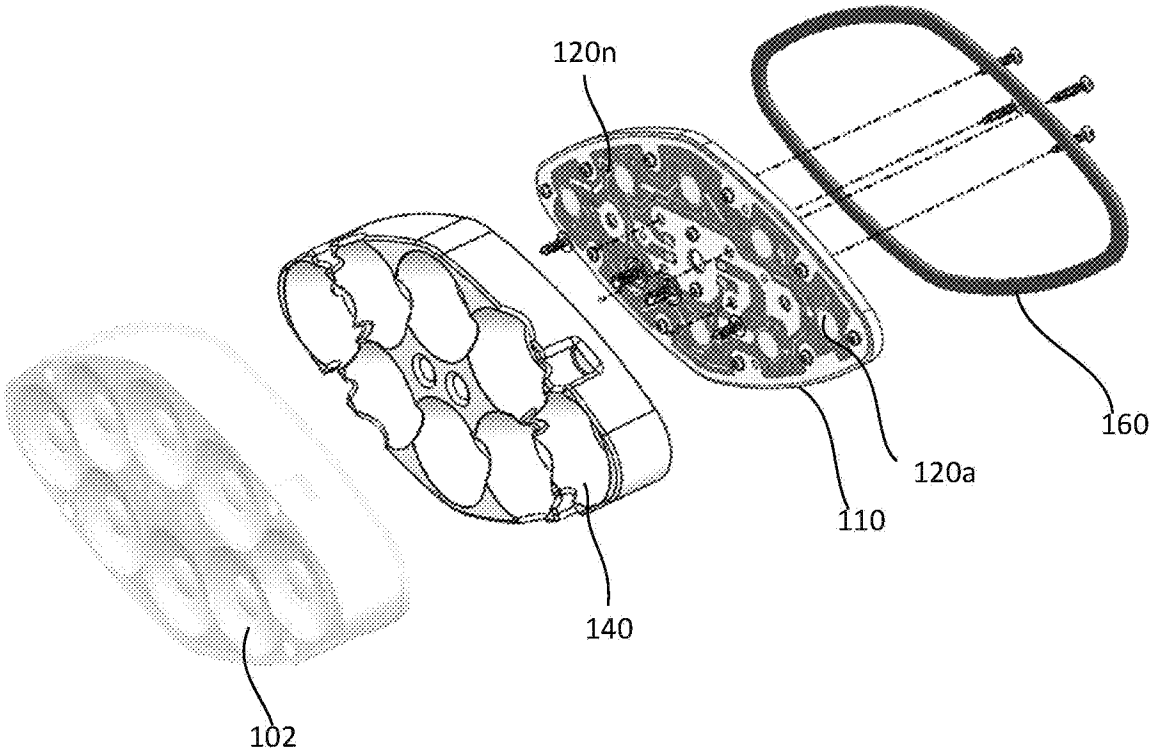
FIG. 1B illustrates an exploded view of the lighting module of FIG. 1A.

FIG. 1A illustrates a perspective view and FIG. 1B illustrates an expanded view of a lighting module 100 of the current disclosure. As shown, the lighting module 100 includes a substrate 110 on which a number of LEDs 120*a-n* are positioned, directly or via one or more intervening layers. The lighting module 100 also includes an optical component 102 positioned over the substrate 110 to protect the substrate 110 and LEDs 120*a-n* from the ambient elements, as well as to focus and/or direct light emitted by the LEDs 120*a-n*. The optical component 102 may be mounted on the substrate 110 via a rigid carrier 140, as described below. Optionally, a gasket 1600 may be used as a compression stop between the optical component 102 and the substrate 110. In certain embodiments, the gasket 160 may also create a seal between the optical component 102 and the substrate 110.

The lighting module 100 may include a set of LEDs 120*a-n* arranged in an array or other configuration, that are positioned to emit light away from the lighting module 100. The LEDs may be chip-on-board (COB) type LEDs, LED die, or any other type of LEDs known to those skilled in the art. Any number of LEDs 120*a-n*, such as one, two, three, four, five or more, sufficient to provide a required intensity lighting module, may be positioned on the substrate 110. In various embodiments, a lighting module may include multiple types of LEDs 120*a-n*. For example, a lighting module may include a first type LEDs that are configured to selectably emit white light of various color temperatures, along with a second type of LEDs that are configured to selectably emit light of various colors.

The LEDs 120*a-n* may be arranged in one or more rows, matrices, or other arrangements with corresponding components supported in place and/or spaced apart by supports. For example, the LEDs may form matrices of n×n LEDs. such as 4×4 or 8×8 matrices. Alternatively, the LEDs 120*a-n* may be positioned in curved rows so that when all modules are positioned within an opening of a light fixture, the light fixture comprises concentric rings of LEDs. The arrangement of LEDs 120*a-n* on the substrate 110 for the purpose of power supply and control may or may not conform to the arrangement of the LEDs in rings, clusters, matrices or other groupings. The lighting module 100 may be a diamond shaped with round corners as shown in FIG. 1A. Although other shapes, such as or a square, circle, oval, rectangle, or the like are within the scope of this disclosure.

In certain embodiments, the substrate 110 may be a supporting structure configured to hold the LEDs 120*a-n* in place. For example, the substrate 110 may be made of any support material (such as fiberglass, ceramic, silicon, or aluminum) with conductive elements (such as traces, bars or wires) placed thereon or therein to direct power, control signal, or the like to the LEDs 120*a-n*. The conductive elements may be copper, silver or another conductive material and applied as conductive ink, wire, traces, or other materials to provide a conductive pathway. Optionally, the substrate 110 may include a portion that is a circuit board (not shown here). Driver circuitry on the circuit board may deliver current to the LEDs 120*a-n* via one or more conductive elements on the substrate, such as conductive lines, traces, bars or wires positioned on the substrate 110. In certain embodiments, various conductors and/or electronic devices may also be mounted on the substrate 120. For example, a set of module-level conductors may be connected to the lighting module's power source and ground. Each module-level conductor may be connected to one of the conductive elements on the substrate 110.

In one or more embodiments, the optical component 102 may be a one-piece structure made of a flexible material. The material for forming the optical component 102 may be selected to provide desirable properties such as, without limitation, preventing off-angle glare, desired optical properties (e.g., total internal reflection, collimate light within the lighting module 100), resistance to impact damage, and/or resistance to degradation from UV, heat and environmental extremes. Examples of materials may include, without limitation, such as optical silicone with the desired opacity value, polycarbonate, acrylic, or the like. The optical silicone may be, for example, a methyl silicone, a vinyl-methyl silicone, a phenyl-vinyl methyl silicone and a fluorine-vinyl-methyl silicone and/or their blends and/or their derivatives.

Figure 2A:
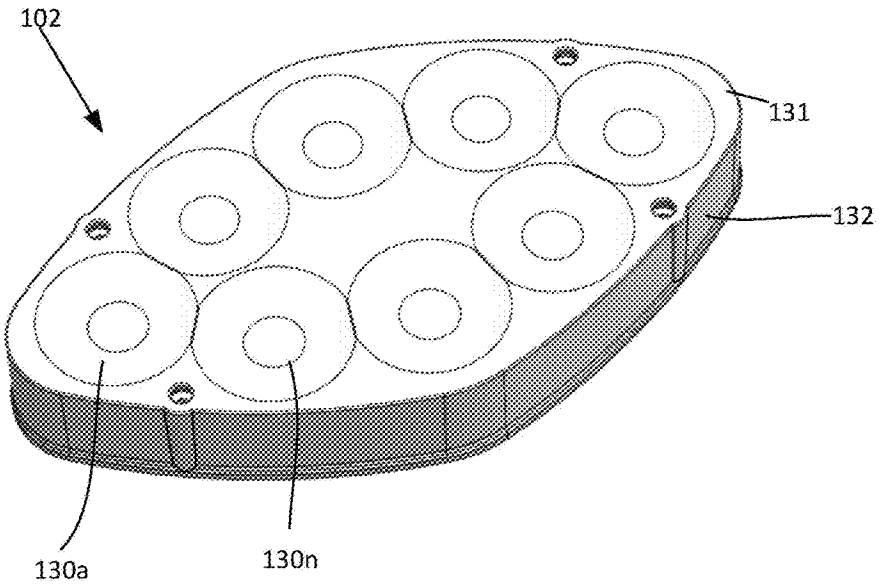
FIGS. 2A and 2B illustrate the top and bottom perspective views of an optical component for a lighting module such as that of FIG. 1A.
Figure 2B:
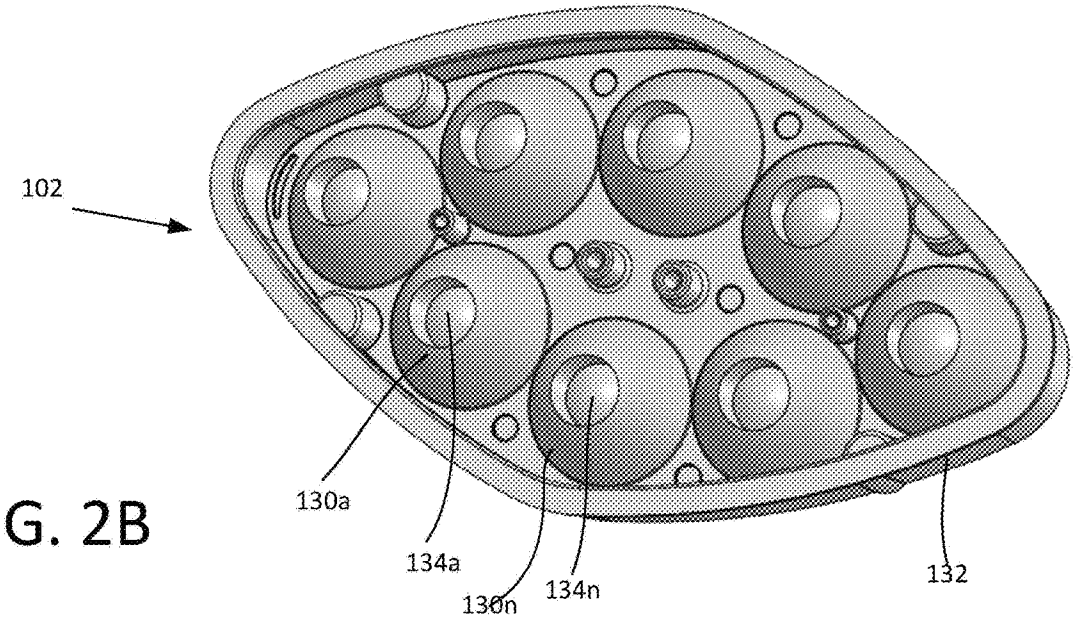

FIGS. 2A and 2B illustrate the top and bottom perspective views of the optical component 102. As shown in FIG. 2A, the optical component 102 includes a top portion 131 and a peripheral portion 132 configured to form an opening in which the carrier 140 may be received. The top portion 131 may include optical elements 130*a-n* that are configured to be positioned over each of the LEDs 120*a-n*. The optical elements 130*a-n* may further be configured to provide the desired optical properties to the light generated by the LEDs 120*a-n* such as, without limitation, beam angle control, stray light reduction, light intensity control, color fringing control, or the like. The spacing of LEDs 120*a-n*, and thus the optical elements 130*a-n*, with respect to each other may vary based on the size of the LEDs 120*a-n*. In an embodiment, the optical elements 130*a-n* may be identical to each other as shown in FIG. 2B. Alternatively, one or more of the optical elements may have a different size, shape, or orientation as compared to the other optical elements. While the current disclosure describes that each of the optical elements 130*a-n* is positioned to fit over a corresponding LED 120*a-n* on the substrate 110, in certain embodiments more than one LEDs may share an optical element.

As shown in FIG. 2B, an optical element 130*a-n* may be a parabolic-shaped optical structure (e.g., lens, reflector, etc.), with the apex of each parabolic-shaped optical structure being disposed on the side that is closer to the corresponding LED and configured to receive light from the corresponding LED. The opposing side of the parabolic-shaped optical structure may be formed to direct the light away from the LED and the lighting module 100. The standoff and slope of each parabolic optical structure may vary depending on the desired beam angle, beam shape, beam spread or other beam properties to be achieved by the lighting module. For example, a lighting module may be provided with parabolics of at least six different shapes to correspond to various beam limiting (collimating) standards.

Figure 3:
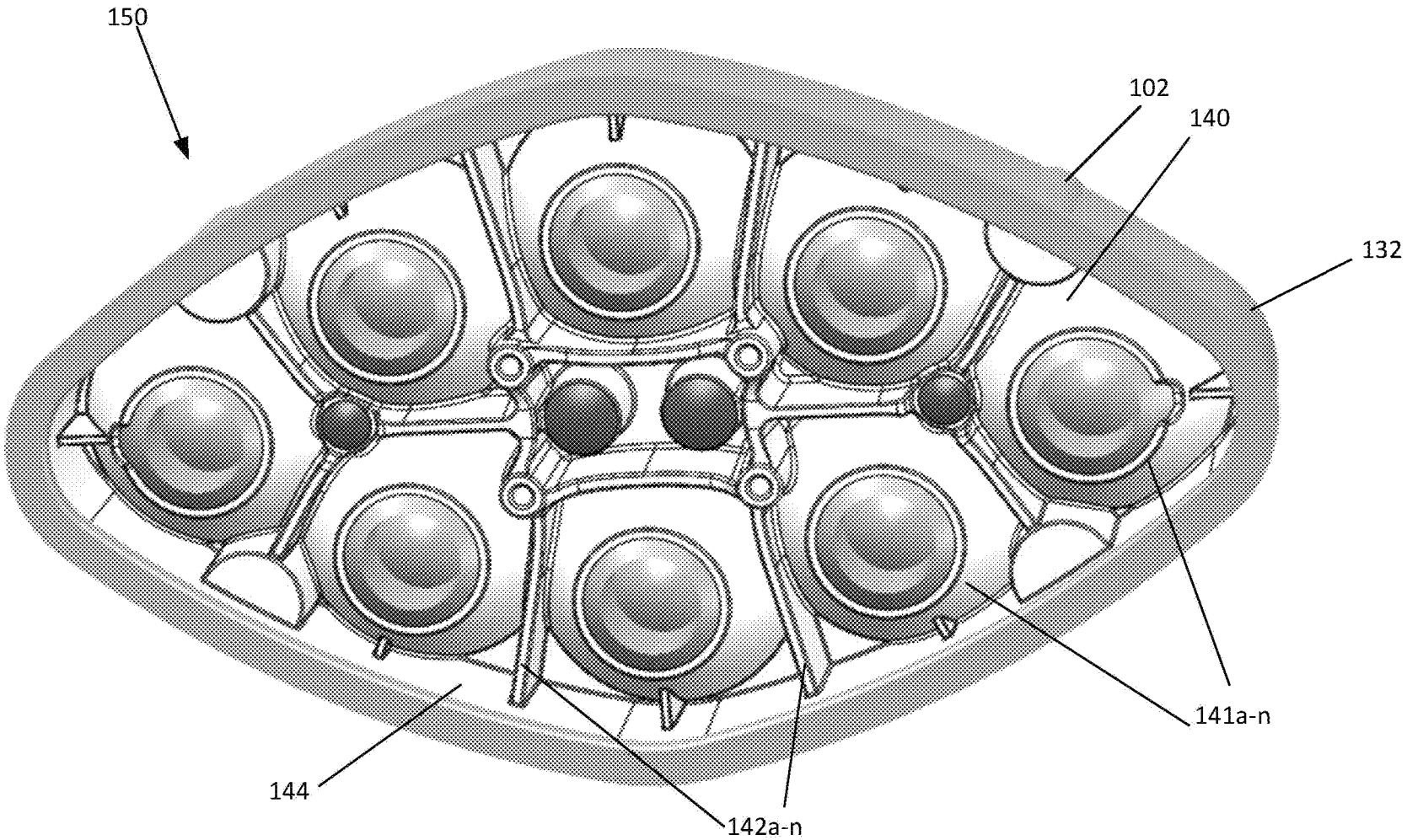
FIG. 3 illustrates a bottom perspective view of an assembly that includes an optical component and a rigid carrier for a lighting module such as that of FIG. 1A.

Additionally and/or alternatively, as shown in FIGS. 2A and 2B and FIG. 3 (described below), each parabolic-shaped optical structure may include a channel 134*a-n* centrally aligned with the axis of the parabolic, and that extends longitudinally (partially or fully) through the body of the parabolic-shaped optical structure. In certain embodiments, the channel may be configured to collimate light in the center region of the parabolic-shaped optical structure and may include material that has a refractive index that is different from that of the material of the body of the parabolic optical structure (e.g., air, or other materials). The shape of the channel may be substantially cylindrical.

Optionally, the optical elements 130*a-n* may include features such as those disclosed in U.S. Patent Application Pub. No. 2014/0334149 filed by Nolan et al or U.S. Patent Application Pub. No. 2015/0167922 filed by Casper et al., the disclosures of which are fully incorporated herein by reference. Other optical structures are possible.

The optical component 102 may be manufactured as a one-piece structure to include the optical elements 130*a-n* in the top portion 131 as integral elements of the optical component 102 by, for example, co-molding, insert-molding, injection molding, or any other similar process. The outer walls of any or all of the optical elements 130*a-n* may be textured or smooth, depending on the characteristics of the mold that is used to form the optical elements.

It will be understood to those skilled in the art that the optical component 102 not only improves the light extraction from the LEDs 120*a-n* and refracts the light to create a desired emission pattern, but the optical component 102 also encapsulates the LEDs 120*a-n* to protect them from contaminants, add mechanical strength, and protect any electrical connections (e.g., traces) on the substrate.

Referring back to FIG. 1B, the optical component 102 may be mounted on the substrate via a rigid carrier 140. The rigid carrier may be made from an inflexible or rigid material in order to, without limitation, provide mechanical strength to the optical component 102, prevent sagging of the optical component 102, and for facilitating as well as maintaining proper alignment of the optical elements 130*a-n* over the corresponding LEDs 120*a-n*. In one or more embodiments, the rigid carrier may be made from, for example and without limitation, polycarbonate, silicon, acrylic, glass, or the like.

FIG. 3 illustrates a bottom view of the rigid carrier 140 attached to the optical component 102 to form assembly 150. As shown in FIG. 3, the rigid carrier 140 may include support structures 141*a-n* configured to receive and support the optical elements 130*a-n*. In certain embodiments, the support structures 141*a-n* may have a shape similar to that of the optical elements 130*a-n* and/or configured to receive the optical elements 130*a-n*. For example, as shown in FIG. 3, the support structures 141*a-n* have a parabolic shape for receiving the parabolic optical elements 130*a-n*, and have an opening that fits over the LEDs 120*a-n*. However other shapes (e.g., hemispherical, conical, etc.) are within the scope of this disclosure. In certain embodiments, the support structures 141*a-n* of the rigid carrier 140 may be configured to act as reflector cups around the optical elements 130*a-n* to minimize the loss of light received from the LEDs 120*a-n*. For example, the support structures 141*a-n* and/or the rigid carrier 140 may be made from while color polycarbonate material that provides reflective properties. Other materials and/or materials coated with a suitable coating to provide desired reflective characteristics for forming the support structures 141*a-n* and/or the rigid carrier 140 are within the scope of this disclosure. The inner carrier 140 may also include lateral connecting structures 142*a-n* that together may fill in all open areas between the support structures 141*a-n*, and/or may be in the form of a web with a group of lateral supports that interconnect the support structures 141*a-n*, as shown in FIG. 3. Optionally, the rigid carrier 140 may include a side wall 144 configured to be fitted under and support the peripheral portion 132 of the optical component 102.

Figure 4A:
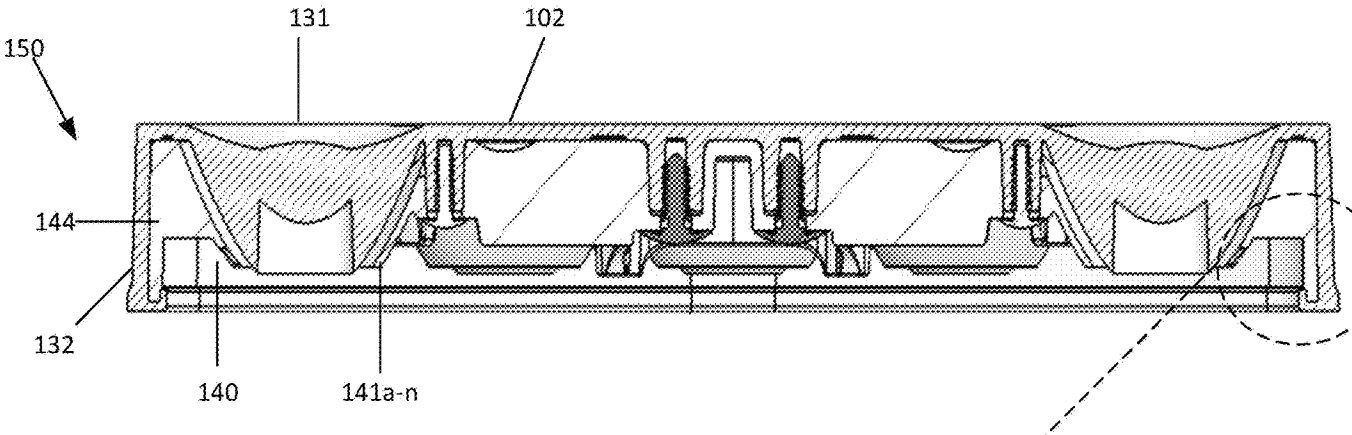
FIG. 4A illustrates a cross sectional view of the assembly shown in FIG. 3.
Figure 4B:
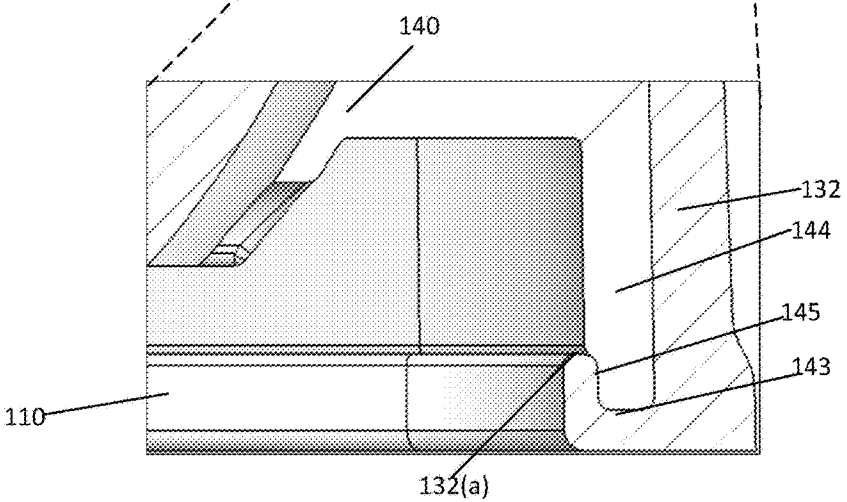
FIG. 4 B illustrates an enlarged close up view of a bottom corner of the assembly shown in FIG. 4A.

FIG. 4A illustrates a cross-section view of the rigid carrier 140 attached to the optical component 102, i.e., assembly 150. As shown in FIGS. 4A and 4B, the peripheral portion 132 of the optical component may extend down along the side wall 144 of the rigid carriers 140. Furthermore, the peripheral portion 132 of the optical component 102 may be stretched such that the bottom edge 132(*a*) of the peripheral portion 132 may wrap around the bottom rim 143 of the side wall 144 rigid carrier 140, and rest against the inside of the side wall 144 of the rigid carrier 140. In certain embodiments, the inside of the side wall 144 of the rigid carrier 140 may include a ridge or indentation 145 for receiving and securing the bottom edge 132(*a*) of the optical component 102 via, for example, a snap-fit, stretch-fit, friction fit, interference fit, press fit, mechanical coupling, or the like, via snapping, fastening, clamping, clasping, clipping, hooking, pushing, attaching, or any other securing mechanism. FIG. 4B illustrates an enlarged view of the inside of the side wall 144 and ridge 145 for receiving and securing the bottom edge 132(*a*) of the optical component 102 (from the cross-section view shown in FIG. 4A). As shown in FIG. 4B, in an example embodiment, the ridge 145 may be formed when a part along the inside of the side wall 144 of the rigid carrier 140 has a thickness that is less than that of the remainder of the side wall 144. The ridge or indentation may be a groove, a notch, a lip or the like. Hence, the optical structure 102 may be stretched and wrapped over the bottom rim 143 of the rigid carrier 140 to form a watertight seal.

Figure 5:
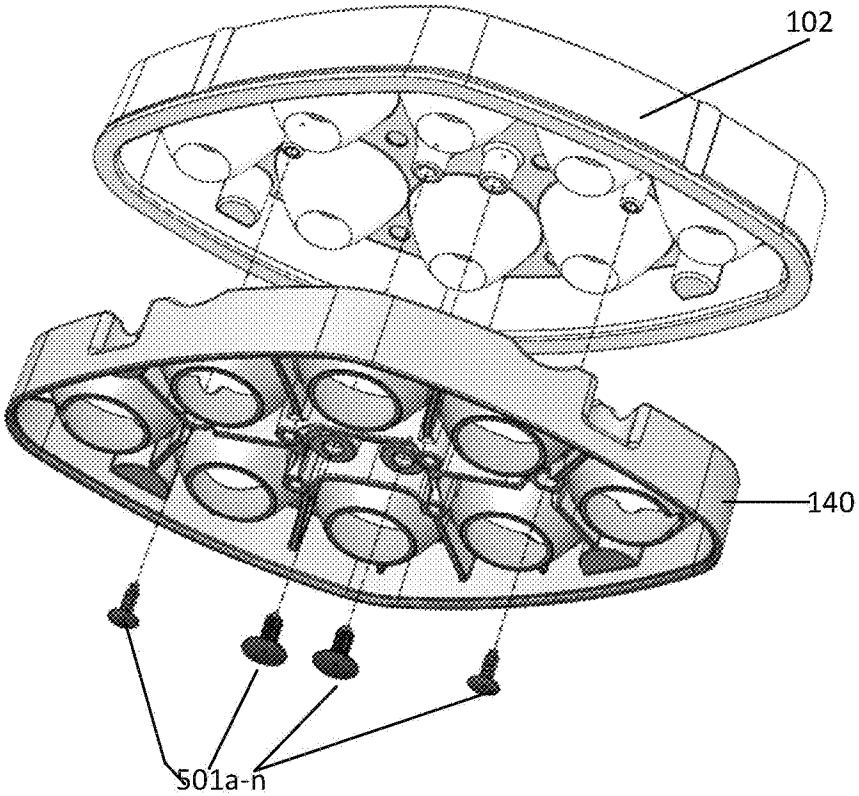
FIG. 5 illustrates an example mechanism for securing an optical component to a rigid carrier for a lighting module such as that of FIG. 1A.

In certain embodiments, the optical structure 102 does not need any additional screws, nuts, bolts, adhesives, etc. to provide a waterproof seal and can be easily assembled into place. In certain other embodiments, the attachment between the optical structure 102 and the rigid carrier 140 may be further secured by using one or more securing mechanisms such as, without limitation, screws, nuts, bolts, adhesives, etc. For example, as shown in FIG. 5, one or more screws 501*a-n* may be used to secure the attachment between the optical structure 102 and the rigid carrier 140. Further, the flexible material of the optical structure 102 allows the peripheral portion 132 to assume a shape that is the same as or similar to that of the rigid carrier 140 side surface geometry for providing a snug fit when attached.

The assembly 150 including the optical structure 102 and the rigid carrier 140 may be mounted over the substrate 110 such that the optical elements 130*a-n* are positioned over the corresponding LEDs 120*a-n*. The assembly 150 may be securely attached to the substrate using any now or hereafter known methods such as without limitation, screws, nuts, bolts, adhesives, snap-fit, stretch-fit, friction fit, interference fit, press fit, mechanical coupling, or the like.

In certain embodiments, a gasket 160 may be added to provide a tight seal between the assembly 150 and the substrate 110 (e.g., sandwiched), and may protect the LEDs 120*a-n* and/or other components inside the LED 120*a-n* and/or the optical cavity formed between the assembly 150 and the substrate 110 from excessive contamination, such as moisture and dust. In certain embodiments, the gasket 160 may be compressed to provide a water tight seal. The gasket can be made from a silicone, thermoplastic elastomers, rubber, foam or other gasket type material. In certain embodiments, the gasket may be co-molded to the optical component 102.

The features and functions described above, as well as alternatives, may be combined into many other systems or applications. Various presently unforeseen or unanticipated alternatives, modifications, variations or improvements may be made by those skilled in the art, each of which is also intended to be encompassed by the disclosed embodiments.

The invention claimed is:

1. A lighting module comprising:

a substrate configured for holding a plurality of light emitting diodes (LEDs);

an optical component comprising:

a plurality of optical elements, each positioned to be located over one of the plurality of LEDs, and a peripheral portion; and a rigid carrier configured to interface with the substrate and seal the optical component to the substrate;

wherein the peripheral portion is configured to wrap around a side wall of the rigid carrier.

2. The lighting module of claim 1, wherein each of the plurality of optical elements comprises a parabolic shaped optical structure and wherein an LED is positioned at a focus of the parabolic shaped optical structure.

3. The lighting module of claim 2, wherein each of the plurality of optical elements further comprises a cylindrical channel that extends longitudinally through that optical element and is configured to be positioned over an LED.

4. The lighting module of claim 1, wherein the optical structure is formed from a flexible material.

5. The lighting module of claim 4, wherein the flexible material is optical silicone.

6. The lighting module of claim 1, wherein the optical component is a one piece structure such that the plurality of optical elements form an integral part of the optical structure.

7. The lighting module of claim 1, wherein the rigid carrier is further configured to provide reflective properties for light emitted by the plurality of LEDs.

8. The lighting module of claim 7, wherein the rigid carrier is formed from an opaque polycarbonate material.

9. The lighting module of claim 1, further comprising a gasket configured to provide a water tight seal between the optical component and the substrate.

10. The lighting module of claim 9, wherein the gasket is formed from material comprising at least one of the following: silicone, thermoplastic elastomers, rubber, or foam.

11. The lighting module of claim 1, further comprising one or more securing means for secure attachment of the optical component to the rigid carrier.

12. The lighting module of claim 1, wherein the rigid carrier comprises a plurality of support structures, each of the plurality of support structures configured to receive and support an optical element of the optical component.

13. The lighting module of claim 12, wherein the rigid carrier further comprises a plurality of lateral connecting structures disposed between the plurality of support structures.

14. The lighting module of claim 1, wherein an inside of the side wall of the rigid carrier comprises a ridge for receiving the peripheral portion of the optical component.

15. The lighting module of claim 1, wherein the peripheral portion of the optical component is configured to assume a shape that is similar to that of the side wall of the rigid carrier.

16. A lighting device comprising:

a housing; and a plurality of lighting modules, each of the plurality of lighting module comprising:

a substrate for holding a plurality of light emitting diodes (LEDs);

an optical component comprising:

a plurality of optical elements, each positioned to be located over one of the LEDs, and a peripheral portion; and a rigid carrier configured to interface with the substrate and seal the optical component to the substrate;

wherein the peripheral portion is configured to wrap around a side wall of the rigid carrier.

17. The lighting device of claim 16, wherein the optical structure is formed from flexible material.

18. The lighting device of claim 17, wherein the flexible material is optical silicone.

19. The lighting device of claim 16, wherein the optical component is a one piece structure such that the plurality of optical elements form an integral part of the optical structure.

20. The lighting device of claim 16, wherein the rigid carrier is further configured to provide reflective properties for light emitted by the plurality of LEDs.

* * * * *